US006171101B1

(12) United States Patent
Freeman et al.

(10) Patent No.: US 6,171,101 B1
(45) Date of Patent: Jan. 9, 2001

(54) DECORATIVE CANDLE DISPLAY

(76) Inventors: Scott H. Freeman, 3632 Rebel Cir., Huntington Beach, CA (US) 92649; Frank H. Asbury, 144 N. Trevor St., Anaheim, CA (US) 92806

( * ) Notice: Under 35 U.S.C. 154(b), the term of this patent shall be extended for 0 days.

(21) Appl. No.: 09/476,945

(22) Filed: Jan. 3, 2000

(51) Int. Cl.[7] ..... F21S 13/12; F23D 3/16; F21V 35/00; C11C 5/00

(52) U.S. Cl. ..... 431/291; 431/288; 431/290; 362/161

(58) Field of Search ..... 431/33, 34, 35, 431/288, 289, 290, 291; 362/161

(56) References Cited

U.S. PATENT DOCUMENTS

| | | | | |
|---|---|---|---|---|
| D. 293,823 | * | 1/1988 | Fieschi et al. | D26/6 |
| 4,332,548 | * | 6/1982 | Linton et al. | 431/289 |
| 4,894,008 | * | 1/1990 | Lee | 431/290 |
| 5,879,694 | * | 3/1999 | Morrison et al. | 424/405 |

FOREIGN PATENT DOCUMENTS

| | | | | |
|---|---|---|---|---|
| 2651035 | * | 5/1978 | (DE) | 431/290 |
| 2630747 | * | 3/1989 | (FR) | 431/290 |
| 2626654 | * | 8/1989 | (FR) | 431/290 |
| 8-212818 | * | 3/1989 | (JP) | 431/291 |
| 8-157864 | * | 6/1996 | (JP) | 431/291 |
| 10-244800 | * | 9/1998 | (JP) | 431/289 |
| 10-308110 | * | 11/1998 | (JP) | 431/290 |

OTHER PUBLICATIONS

"What Is Wax?–Petroleum Wax Manufacturing–Simple Overview"—2 web pages (undated).
"Candle Making—Waxes"—3 web pages (undated).
"Making Candles", by Mary Talbot, 3 pages (undated).
"Candle Creations", by James W. Gick, Jr., Index and Foreword and 3 pages (undated).
"Homespun Floral Candles", Country Living Gardener, Nov./Dec. 1996, pp. 92 and 93.

* cited by examiner

*Primary Examiner*—Carl D. Price
(74) *Attorney, Agent, or Firm*—Stetina Brunda Garred & Brucker

(57) ABSTRACT

A decorative candle display including a non-opaque container of a defined geometrical shape and volume, and a heat-meltable, non-opaque candle placeable within this container. The candle has a defined geometrical shape which can be substantially complimentary to the shape of the container. Within the non-opaque gel of the candle are a plurality of image-producing gaseous cells and a conventional ignitable wick extending substantially there through with an exposed end for lighting. The density of the gel and the volume of the container are cooperatively correlated such that the volume of the container accommodates a sufficient quantity of water in which the candle will float upon introduction of this sufficient water quantity into the container. Ignition of the wick of the floating candle results in passage of light caused by the flame through the non-opaque, and preferably substantially transparent, gel and finally through the non-opaque, and preferably substantially transparent, container within which the candle is situated. The gaseous cells formed within the gel allow projection of images corresponding to the shapes and sizes of the cells on surrounding surfaces as light is transmitted through the gel, thereby creating a unique candle-light glow effect above, below, and around the display.

30 Claims, 3 Drawing Sheets

Fig. 3
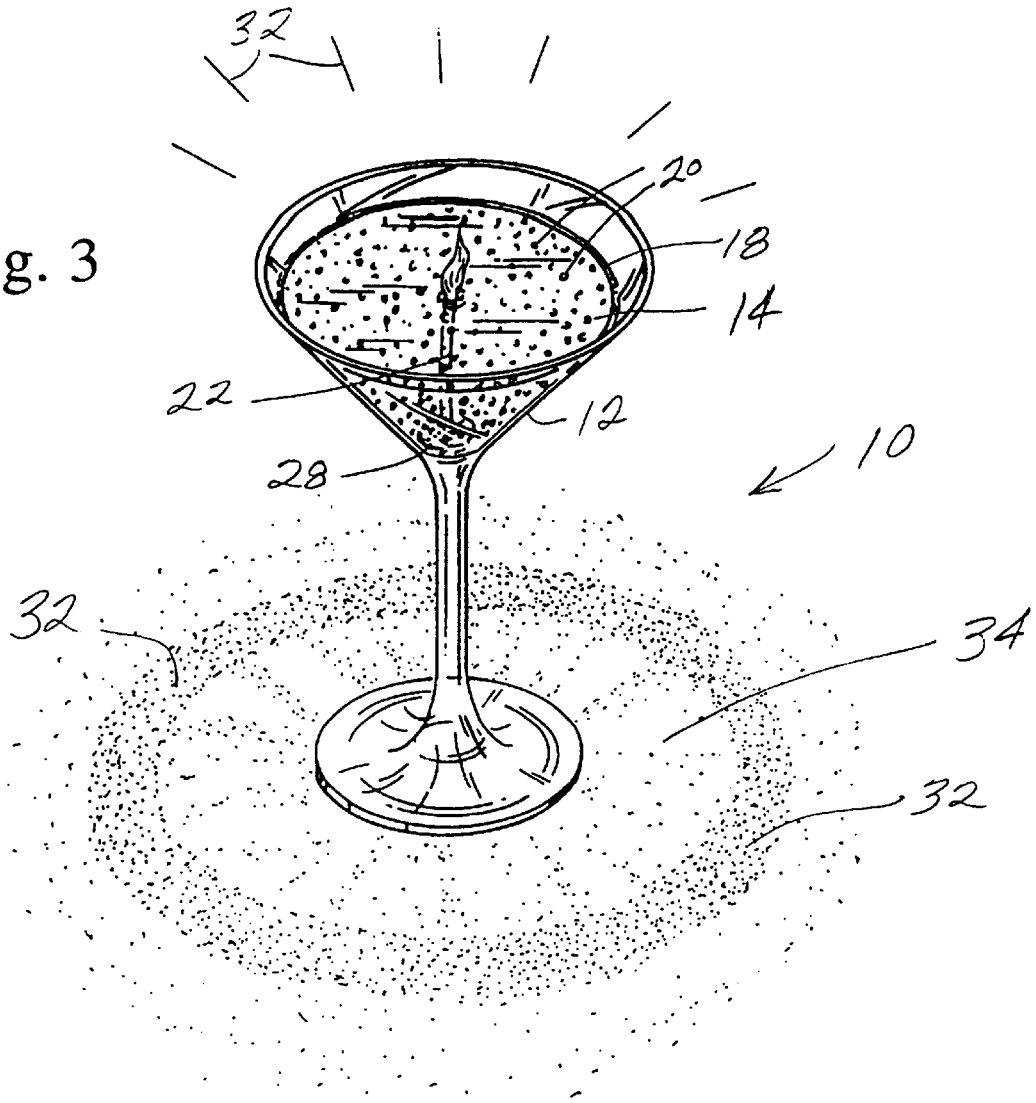
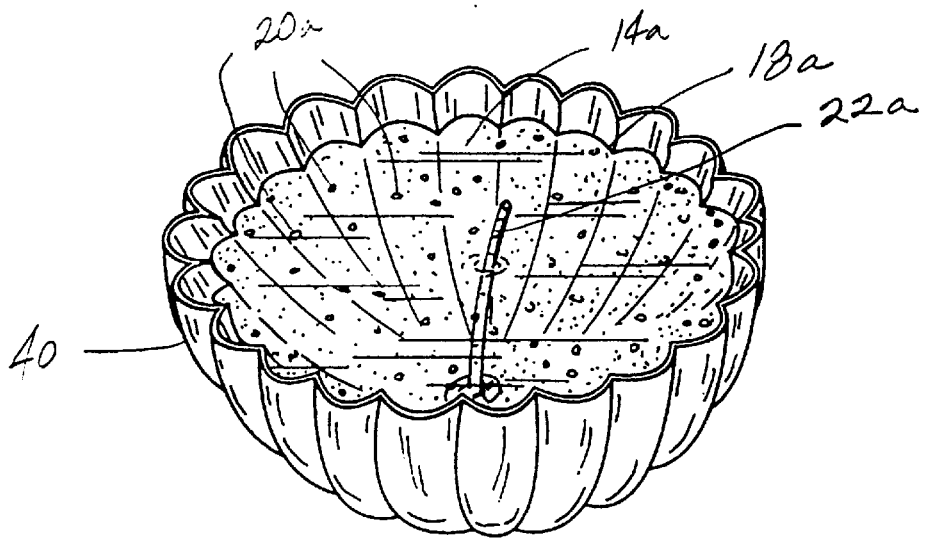
Fig. 4

DECORATIVE CANDLE DISPLAY

FIELD OF THE INVENTION

This invention relates in general to lighted candle decorations, and in particular to a decorative candle display in which a shaped candle fabricated of a non-opaque, image-producing gel is floatable in water within a non-opaque container to thereby project when lighted an illuminated array of images about the container.

BACKGROUND OF THE INVENTION

The use of candle light is a well-recognized ambience enhancer in producing a warm and comfortable atmosphere where people gather. Such use of candle light is found in commercial establishments such as restaurants, clubs, and the like where customers are invited to relax and enjoy a flickering illumination and, hopefully, to beneficially gain a feeling of contentment. In a similar manner candle light is used in homes to mute otherwise blaring lights and bright-white walls so often present in typical living rooms, dining rooms, and other locations for family gatherings. While probably not scientifically provable, many find that such softened illumination begets a positive tenor.

Because of the popularity of candle illumination in general, many types of candle displays have been developed. Thus, in addition to traditional cylindrical candles mounted in candle stick holders, various types of decorative candle housings are available, including numerous container designs for accommodating votive-style candles. Additionally, floating candle displays are provided in which wax or gel candles float in water present in variously-sized bowls or other vessels that may have decorative wall topography which enhances visual observations. However, while such present floating candle displays certainly provide enjoyment, they do not really enhance the basic light production from a wick-only location as found in any present candle. As a result, it is evident that a need is present for a decorative candle display where the candle itself in cooperation with its companion container can produce a unique lighting effect in an immediately adjacent vicinity. Accordingly, a primary object of the present invention is to provide a decorative candle display wherein the candle is floatable and is fabricated of a non-opaque gel capable of projecting light and unique images on encircling surfaces.

Another object of the present invention is to provide a decorative candle display wherein the floatable candle is a defined geometrical shape which is substantially identical to a defined geometrical shape of the container in which the candle resides.

Yet another object of the present invention is to provide methodology for producing a decorative candle display embodying image projection by the candle through the wall structure of a non-opaque container.

These and other objects of the present invention will become apparent throughout the description thereof which now follows.

SUMMARY OF THE INVENTION

The present invention is a decorative candle display comprising a non-opaque container of a defined geometrical shape and volume, and a heat-meltable, non-opaque candle placeable within this container. The candle has a defined geometrical shape which can be substantially complimentary to the shape of the container. Within the non-opaque gel forming the candle are a plurality of image-producing gaseous cells and a conventional ignitable wick extending substantially there through with an exposed end for lighting. The density of the gel and the volume of the container are cooperatively correlated such that the volume of the container accommodates a sufficient quantity of water in which the candle will float upon introduction of this sufficient water quantity into the container.

Ignition of the wick of the floating candle of this decorative display results in passage of light caused by the flame through the non-opaque, and preferably substantially transparent, gel and finally through the non-opaque, and preferably substantially transparent, container within which the candle is situated. The gaseous cells formed within the gel allow projection of images corresponding to the shapes and sizes of the cells on surrounding surfaces as light is transmitted through the gel, thereby creating a unique candle-light glow effect above, below, and around the display.

BRIEF DESCRIPTION OF THE DRAWINGS

An illustrative and presently preferred embodiment of the invention is shown in the accompanying drawings in which:

FIG. 3 is a perspective view of the container of FIG. 1 having therein an illuminated floating candle;

FIG. 4 is a perspective view of a second container with a complimentarily shaped candle therein.

DETAILED DESCRIPTION OF THE PREFERRED EMBODIMENTS

Figure 1:
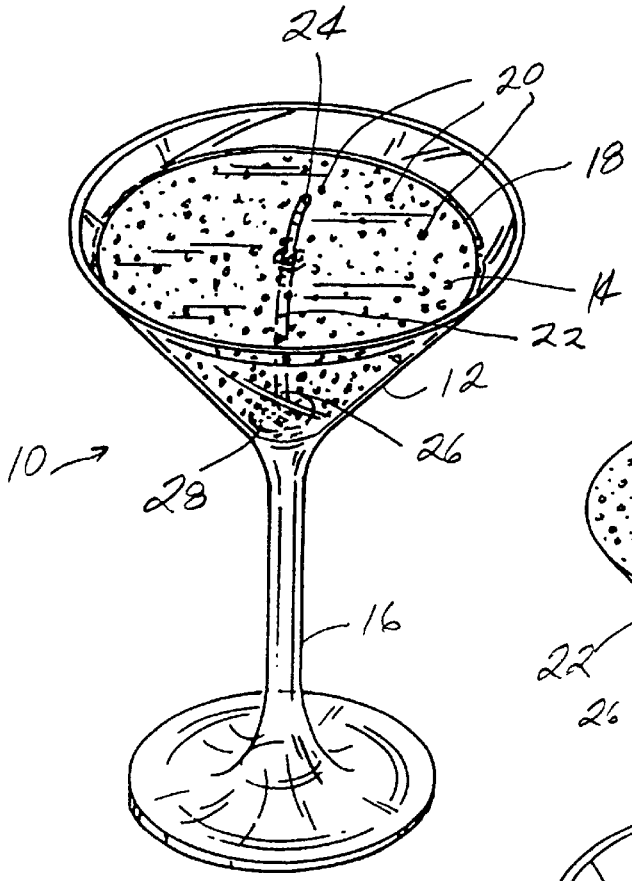
FIG. 1 is a perspective view of a container with a complimentarily shaped candle therein.
Figure 2:
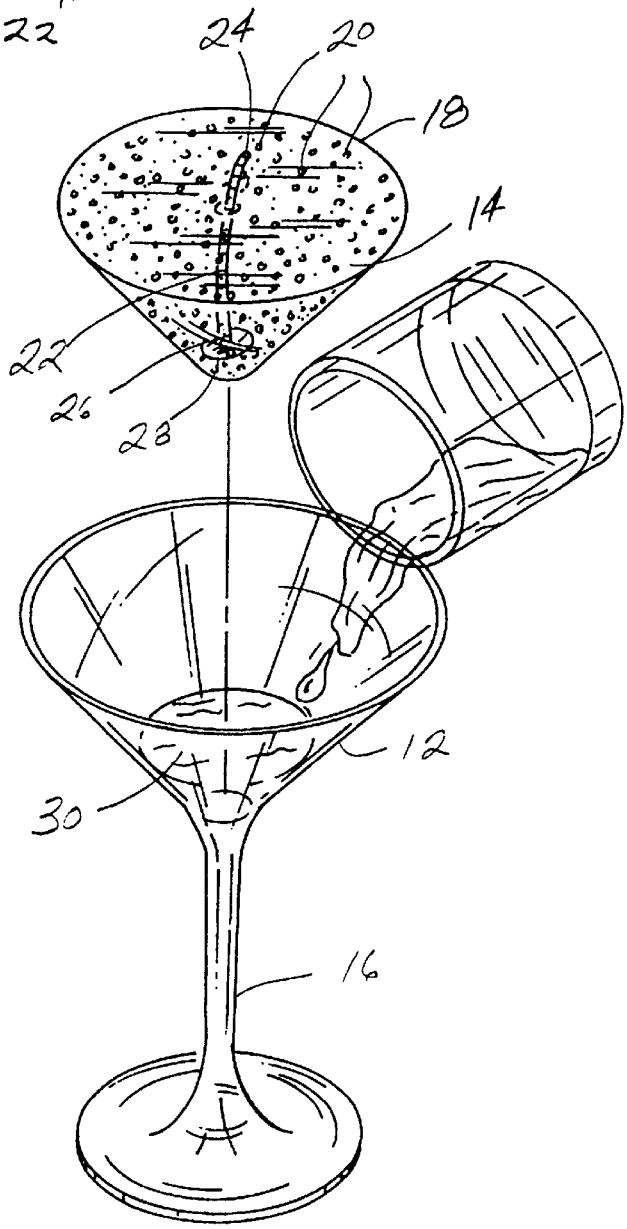
FIG. 2 is a perspective view illustrating the addition of water to the container of FIG. 1 to enable floating of the candle in the container.

Referring to FIGS. 1–3, a decorative candle display 10 is illustrated. The display 10 includes a substantially funnel shaped transparent container 12 having a substantially stem-shaped lower support 16. Within the container 12 is a gel candle 18 formed of a heat-meltable substantially transparent gel 14 having a defined geometric shape substantially complimentary to the shape of the container 12. The gel 14 is prepared from a gelatinous mineral oil as exemplified by "Candle Gel" and "Versa Gel," both manufactured by Penrico Company of Woodlands, Texas. The gelatinous mineral oil is heated to reduce viscosity and vigorously stirred or otherwise aerated as recognized in the art to aerate the gel 14 and thereby introduce gaseous cells 20 of air to the gel 14. If desired, a standard fragrance and/or dye can be added to the heated gel 14 for presence in the final gel candle 18. A wick 22 is placed within the heated gel 14 such that one end 24 thereof is exposed for ignition while the other end 26 thereof is within a non-oxidizable encasement such as a stainless steel saucer base 28 so that oxidation and therefore rusting of the encasement does not occur when the gel candle 18 is floating in water as described later. The heated gel 14 is then allowed to cool to room temperature while within a shaping form which can be the container 12 itself or a like-shaped mold to thereby form the gel candle 18 which maintains its shape once at room temperature.

The display 10 is made operational as illustrated in FIGS. 2 and 3. In particular, a sufficient quantity of water 30 is poured into the container 12 to permit the gel candle 18 to float therein, and the gel candle 18 is then placed within the container 12. Thereafter, the exposed end 24 of the wick 22 is lighted as depicted in FIG. 3 to thereby transmit light and project images 32 above, below, and around the display 10 corresponding to the shapes and sizes of the gaseous cells 20 on surrounding surfaces 34 as light is transmitted through the gel 14, thereby creating a unique candle-light pattern.

FIG. 4 illustrates a second container 40 having a defined geometrical shape and housing a gel candle 18*a* produced as described above in connection with the gel candle 18 of FIGS. 1–3. As is shown, a partially exposed wick 22*a* is disposed within the gel candle 18*a*, while the gel 14*a* thereof has therein gaseous cells 20*a* of air produced as defined above and additionally can have blended therewith a standard fragrance and/or dye in the same manner as described above. The container 40 can function as a mold and preferably as a package support to precisely maintain the candle 18*a* in its desired shape until its placement in water for floating within a vessel that may or may not be of substantially the same shape.

Figure 5:
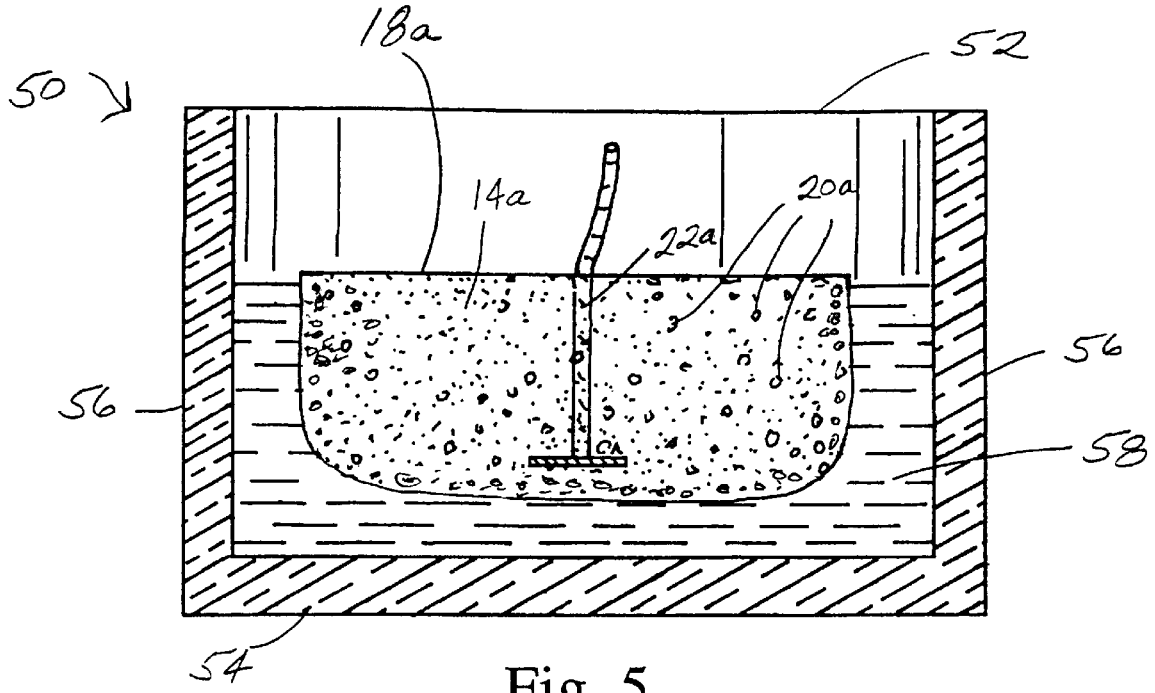
FIG. 5 is a side elevation view in section of a third container with a floating, non-structurally confined candle.

FIG. 5 illustrates a decorative candle display 50 showing a container 52 in cross section. The container has a substantially transparent floor 54 and substantially transparent vertical walls 56, and is shown with a quantity of water 58 within which the gel candle 18*a* of FIG. 4 is floating after its removal from the container 40. While the gel candle 18*a* does not come in contact with the walls 56, when lighted it transmits light and project images upwardly, downwardly, and laterally corresponding to the shapes and sizes of the gaseous cells 20*a* on surrounding surfaces as light is transmitted through the gel 14*a*.

As is apparent, the above described candle displays accomplish an enhancement of candle light enjoyment. While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. A decorative candle display comprising:

a) a non-opaque container of a defined geometrical shape and volume; and b) a candle placeable within the container, said candle formed of a heat-meltable non-opaque gel having a defined geometrical shape substantially complimentary to the shape of the container and having a plurality of speck-like image-producing gaseous cells therein and an ignitable wick extending substantially there through and partially therefrom, wherein the gel and the volume of the container cooperate whereby the gel is of a density such that the volume of the container accommodates a sufficient quantity of water in which the candle will float upon introduction of said quantity into the container while remaining generally juxtaposed with the geometrical shape of the container.

2. A decorative candle display as claimed in claim 1 wherein the container is substantially transparent.

3. A decorative candle display as claimed in claim 2 wherein the container is substantially funnel-shaped and has a substantially stem-shaped lower support.

4. A decorative candle display as claimed in claim 1 wherein the gel is substantially transparent.

5. A decorative candle display as claimed in claim 1 wherein the gel additionally comprises a fragrance.

6. A decorative candle display as claimed in claim 1 wherein the gel additionally comprises a dye.

7. A decorative candle display as claimed in claim 1 wherein a non-oxidizable encasement surrounds a base portion of the wick within the gel.

8. A decorative candle display comprising:

a) a non-opaque container of a defined geometrical shape and volume; and b) a candle placeable within the container, said candle formed of a heat-meltable non-opaque gel having a defined geometrical shape, a plurality of speck-like image-producing gaseous cells therein, and an ignitable wick extending substantially there through and partially therefrom, wherein the gel and the volume of the container cooperate whereby the gel is of a density such that the volume of the container accommodates a sufficient quantity of water in which the candle will float upon introduction of said quantity into the container.

9. A decorative candle display as claimed in claim 8 wherein the container is substantially transparent.

10. A decorative candle display as claimed in claim 9 wherein the container is substantially funnel-shaped and has a substantially stem-shaped lower support.

11. A decorative candle display as claimed in claim 8 wherein the gel is substantially transparent.

12. A decorative candle display as claimed in claim 8 wherein the gel additionally comprises a fragrance.

13. A decorative candle display as claimed in claim 8 wherein the gel additionally comprises a dye.

14. A decorative candle display as claimed in claim 8 wherein a non-oxidizable encasement surrounds a base portion of the wick within the gel.

15. A method of producing a decorative candle display comprising the steps of:

a) providing a non-opaque container of a defined geometrical shape and volume;

b) providing a candle placeable within the container, said candle formed of a heat-meltable non-opaque gel having a defined geometrical shape substantially complimentary to the shape of the container and having a plurality of speck-like image-producing gaseous cells therein and an ignitable wick extending substantially there through and partially therefrom, wherein the gel and the volume of the container cooperate whereby the gel is of a density such that the volume of the container accommodates a sufficient quantity of water in which the candle will float upon introduction of said quantity into the container while remaining generally Juxtaposed with the geometrical shape of the container; and c) introducing said quantity of water into the container and thereafter placing the candle in the water.

16. A decorative candle display as claimed in claim 15 wherein the container is substantially transparent.

17. A method of producing a decorative candle display as claimed in claim 16 wherein the container is substantially funnel-shaped and has a substantially stem-shaped lower support.

18. A method of producing a decorative candle display as claimed in claim 15 wherein the gel is substantially transparent.

19. A method of producing a decorative candle display as claimed in claim 15 wherein the gel additionally comprises a fragrance.

20. A method of producing a decorative candle display as claimed in claim 15 wherein the gel additionally comprises a dye.

21. A method of producing a decorative candle display as claimed in claim 15 wherein a non-oxidizable encasement surrounds a base portion of the wick within the gel.

22. A method of producing a decorative candle display as claimed in claim 15 wherein the candle is maintained by a like-shaped package support until placing the candle in the water.

23. A method of producing a decorative candle display comprising the steps of:

a) providing a non-opaque container of a defined geometrical shape and volume;

b) providing a candle placeable within the container, said candle formed of a heat-meltable non-opaque gel having a defined geometrical shape, a plurality of speck-like image-producing gaseous cells therein, and an ignitable wick extending substantially there through and partially therefrom, wherein the gel and the volume of the container cooperate whereby the gel is of a density such that the volume of the container accommodates a sufficient quantity of water in which the candle will float upon introduction of said quantity into the container; and c) introducing said quantity of water into the container and thereafter placing the candle in the water.

24. A decorative candle display as claimed in claim 23 wherein the container is substantially transparent.

25. A method of producing a decorative candle display as claimed in claim 24 wherein the container is substantially funnel-shaped and has a substantially stem-shaped lower support.

26. A method of producing a decorative candle display as claimed in claim 23 wherein the gel is substantially transparent.

27. A method of producing a decorative candle display as claimed in claim 23 wherein the gel additionally comprises a fragrance.

28. A method of producing a decorative candle display as claimed in claim 23 wherein the gel additionally comprises a dye.

29. A method of producing a decorative candle display as claimed in claim 23 wherein a non-oxidizable encasement surrounds a base portion of the wick within the gel.

30. A method of producing a decorative candle display as claimed in claim 23 wherein the candle is maintained by a like-shaped package support until placing the candle in the water.

* * * * *